United States Patent [19]

Marcin

[11] 4,226,203

[45] Oct. 7, 1980

[54] FLOATABLE CONCRETE PALLET FOR LIFTING AND BEARING HEAVY LOADS

[75] Inventor: Benjamin G. Marcin, Houston, Tex.

[73] Assignee: Pullman Incorporated, Chicago, Ill.

[21] Appl. No.: 945,269

[22] Filed: Sep. 25, 1978

[51] Int. Cl.[3] ..... B63B 5/14

[52] U.S. Cl. ..... 114/65 A; 108/901; 114/264

[58] Field of Search ..... 114/26, 65 A, 77 R, 114/263, 264, 267, 322; 405/195, 203, 204, 205, 207, 219, 222, 223; 108/51.1, 901; 14/27

[56] References Cited

U.S. PATENT DOCUMENTS

| | | | |
|---|---|---|---|
| 1,908,714 | 5/1933 | Schneider | 114/264 |
| 3,152,570 | 10/1964 | Dyer | 114/267 X |
| 3,262,411 | 7/1966 | Kaltenecker | 114/270 X |
| 3,631,831 | 1/1972 | Sutherland | 114/65 A |
| 3,691,965 | 9/1972 | Cloyd | 108/5.1 |
| 3,759,207 | 9/1973 | Terai | 114/77 R X |
| 3,951,085 | 4/1976 | Johnson et al. | 114/65 A X |
| 4,011,826 | 3/1977 | Yee | 114/26 X |

FOREIGN PATENT DOCUMENTS

| | | | |
|---|---|---|---|
| 129084 | 8/1950 | Sweden | 108/51.1 |

*Primary Examiner*—Trygve M. Blix
*Assistant Examiner*—Winston H. Douglas
*Attorney, Agent, or Firm*—Kurt S. Myers; C. W. Crady

[57] ABSTRACT

A pallet having a precast, prestressed concrete grillage superstructure including layers of elongate elements, each successively higher layer being transverse to the layer below it for heavy load bearing objects such as an industrial processing plant. The long elements are not only useful in providing the load-bearing points, but are useful in providing long channels between the elements which are useful as manways and for carrying pipe, conduits and the like that are associated with an industrial processing plant, the heavy load typically lifted and carried by such a pallet. The intersection points or junctions of the elements from layer to layer are load bearing points for distributing in radiating fashion the load placed on the top deck slab of the pallet. The pallet is suitable for transport by a submersible seaworthy vessel located beneath the pallet. The pallet is preferably constructed using simplified prefabrication techniques, the individual elements being joined together by anchors and seats which are conventional in prestressed concrete structures.

8 Claims, 9 Drawing Figures

FIG. 1
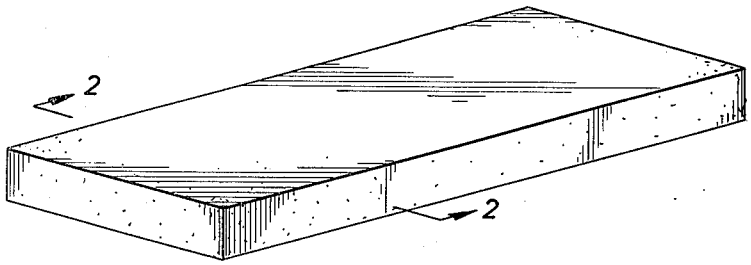
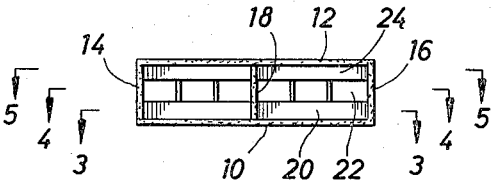
FIG. 2
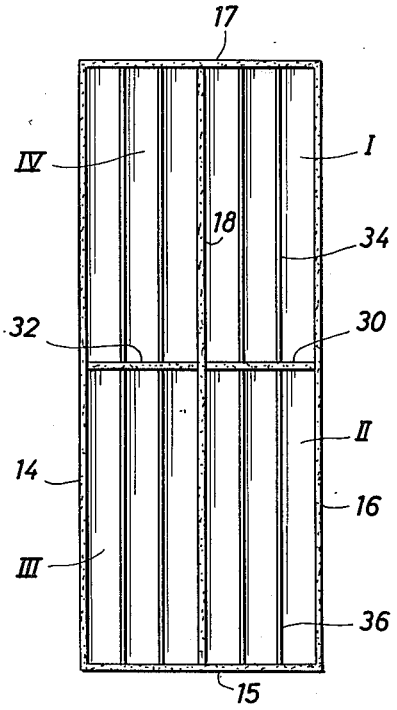
FIG. 4
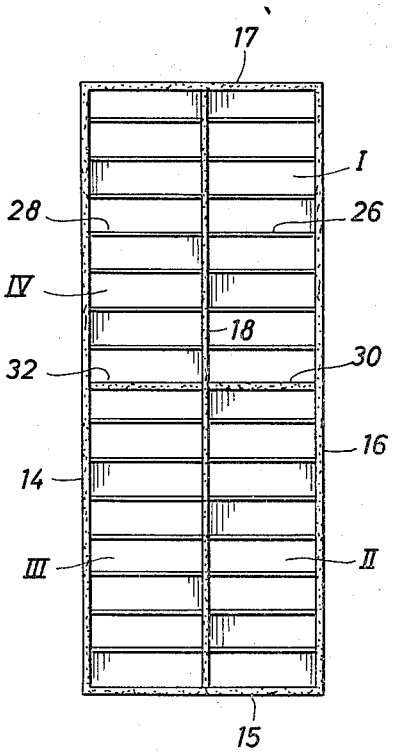
FIG. 3
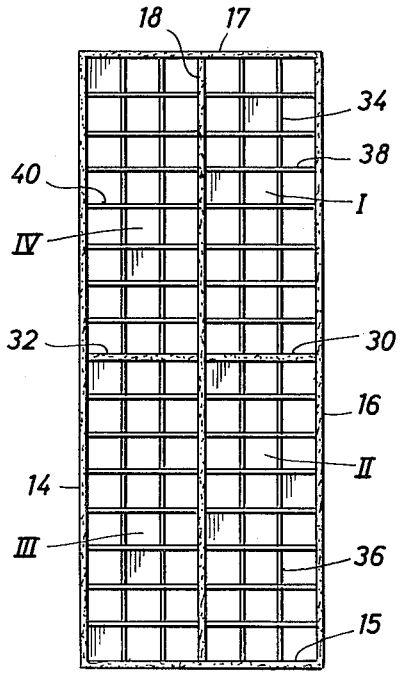
FIG. 5

FIG. 6
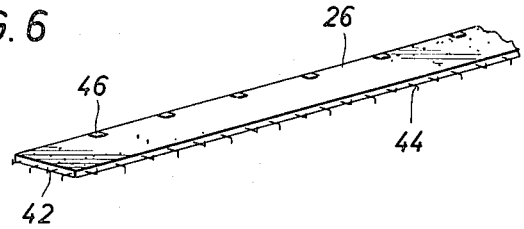
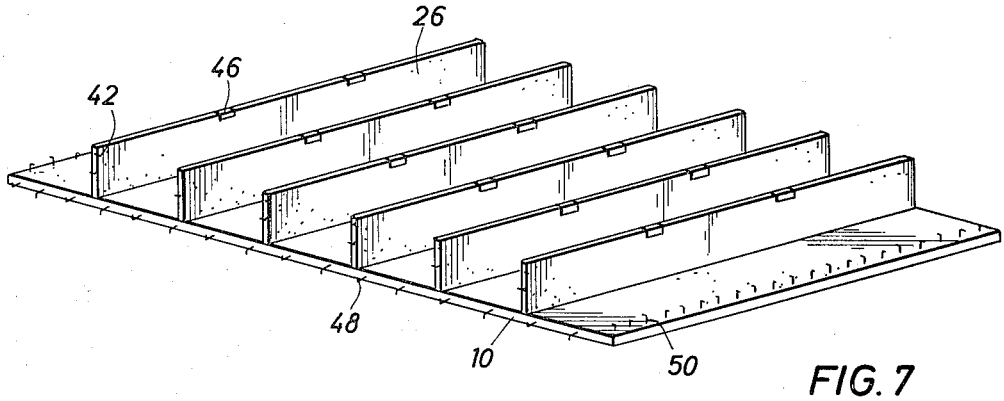
FIG. 7
FIG. 8
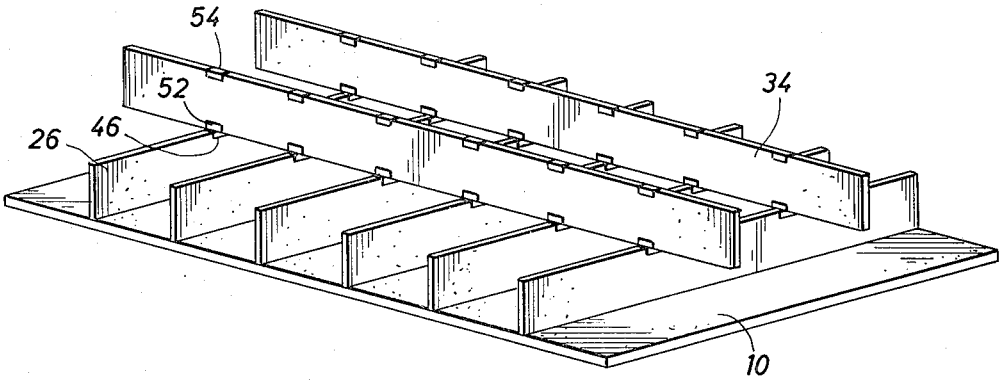
FIG. 9
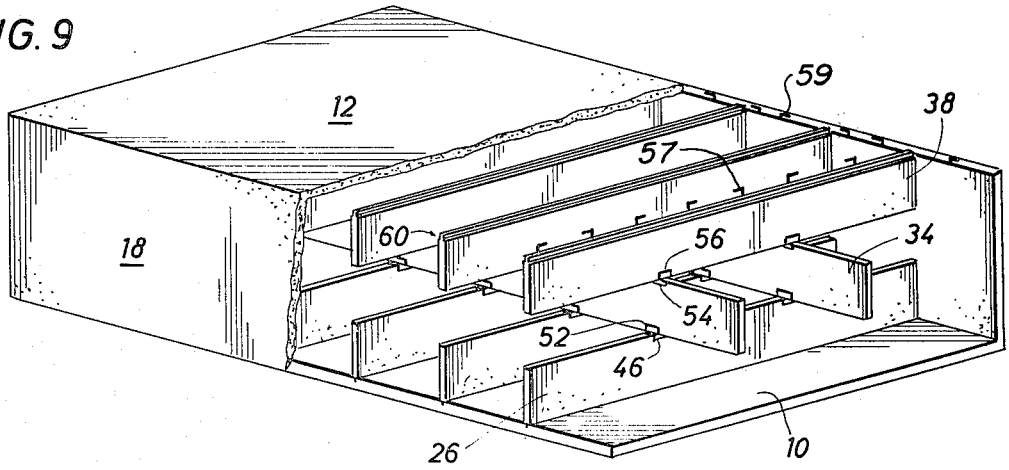

FLOATABLE CONCRETE PALLET FOR LIFTING AND BEARING HEAVY LOADS

BACKGROUND OF THE INVENTION

1. Field of the Invention

This invention relates to a combination load-bearing foundation for industrial plants and the like that is also useful as a floatable pallet capable of being supported by a submersible vessel located therebeneath to transport both the pallet and industrial plant or the like and the method of constructing such a pallet of precast, prestressed elements using conventional techniques used in prestressed concrete structures, and thereby avoiding shipyards and costly and complicated special construction techniques.

2. Description of the Prior Art

It has been recognized that it is difficult to construct certain chemical processing plants in some locations because of the difficulty with local conditions. These conditions can be many, but among conditions that cause great difficulty are local unavailability or shortages of materials and equipment from which to make the plant and the unavailability or scarcity of skilled labor with which to carry out the construction. Such conditions do not only exist in underdeveloped countries, but may occur in areas of developed countries, because of specific local unfavorable conditions.

Hence, it has been recognized that there are definite potential advantages in the construction and transport of such plants from a location where building such a plant is favorable to the installation location of the plant where the local conditions are unfavorable.

One such attempt is described in U.S. Pat. No. 3,262,411, Kaltenecker. This patent describes a so-called portable process plant including a base which is a barge, the super-structure of which is independently oceanworthy against all of the strains and stresses encountered by a barge being towed at sea. The barge hull is constructed of reinforced concrete having numerous longitudinal and transverse walls defining compartments. These walls run throughout the breadth and length of the hull and are stated to be essential for rigidity and strength. Other structure is added to further increase its seaworthiness.

Other examples of floating barge constructions, some of which suggest their suitability for carrying all or part of an industrial plant, include U.S. Pat. No. 2,605,733, Smith; U.S. Pat. No. 3,691,974, Seiford, et al.; and U.S. Pat. No. 4,041,721, Kniel. Smith shows a structure of making a unitary barge by clamping together sections of a special design; Seiford, et al., shows another sectionally constructed barge joined together by special junction assemblies; and Kniel shows a compartmentalized hull particularly suited for installation of a natural gas liquification plant.

The following U.S. patents show modular construction for barges, dry docks, boat piers, marinas and the like: U.S. Pat. Nos. 3,665,882, Georgier, et al.; 3,221,696, Gardner; 3,779,192, Gonzalez; 3,983,830, Morgan; 4,067,285, Jones, et al.; and 2,728,319, Engstrand. Georgier, et al., shows a polyhedral modular structure; Gardner shows special universal mechanical couplings for adjacent sections; Gonzalez shows a modular structure, the outside material thereof being specially designed; Morgan shows the method of assembling a modular barge using tensioning cables serially threaded therethrough; Jones, et al., shows a hexagonal structure comprising triangular modules; and Engstrand shows sections particularly suitable for a dry dock, which are assembled in such a way to resist the bending moment of the dock.

The following U.S. patents show multiple barges or floating seaworthy vessels being joined together to function together to support a large load: U.S. Pat. Nos. 3,765,359, Takezawa, et al.; 3,962,981, O'Kon, et al.; and 3,785,314, Scanlan.

One inventor who has been fairly prolific in designing unitary marine structures suitable for support and transport of a large load, such as an industrial process plant, is Alfred A. Yee, who is the inventor named in U.S. Pat. Nos. 3,324,814; 3,833,035 and 4,011,826. U.S. Pat. No. 3,224,814 shows a main framework having a plurality of longitudinally spaced and transversely extending upright open frame-like steel or reinforced concrete rib sections. The other two Yee patents show structures which show the use of honeycomb or vertically extending components, either tangentially joined together or joined together by interconnecting ribs.

In spite of all the efforts expended by Yee and others to construct a suitable floatable plant-carrying vessel, the primary emphasis has been on making such a vessel independently seaworthy (i.e., a self-contained barge), of modular construction either of components to make a barge or of barge components to make a multi-barge vessel, or has been an attempt to develop a superstructure that would be desirably lightweight and capable of bearing a large load. No special attention has been made for providing a structure having fanned out support points and also having numerous long uninterrupted horizontal channels.

Therefore, it is a feature of the present invention to provide an improved floatable pallet for an industrial plant or other large load, comprising precast, prestressed grillage elements arranged in such a way to provide radiating load-bearing, descending through the pallet.

It is another feature of the present invention to provide such an improved floatable pallet having elongated channels therethrough for carrying pipes, conduits and the like needed for connecting together the operating parts of the supported plant.

It is still another feature of the present invention to provide such an improved floatable pallet having grillage elements which are capable of simple fabrication and assembly using techniques well-known in forming prestressed concrete structures, so that the entire pallet can be made without the need for a shipyard or other special construction site.

It is yet another feature of the present invention to provide such an improved floatable pallet fully capable of being borne by a seaworthy vessel or vessels, but itself not having to meet the requirements of having to be independently oceanworthy, and further fully capable of being the support base for the finally installed plant.

SUMMARY OF THE INVENTION

The embodiments of the present invention disclosed herein are of a floatable concrete pallet. The pallet, having a top and bottom deck slab and side and end bulkheads all around, may internally include multiple large vertical compartments separated from each other by internal bulkheads. Each pallet has internally alternate layers of rows of precast, prestressed concrete elements. These elements run the entire distance from vertical bulkhead to vertical bulkhead in pallets having multiple compartments or from side to side or end to end bulkheads for a one-compartment pallet. The individual elements of the second layer are supported by and cross, usually at 90°, the elements of the bottom layer and so forth, the supporting junctions being "seats." Hence, a load at the top is borne in radiating fashion through the supporting structure.

The elements of a layer provide long channels, and since there are large spaces between the seats from layer to layer, the running of pipe or conduits is possible within the pallet.

The method of making such a pallet involves step-by-step procedures for making and joining precast, prestressed concrete elements which individually are well known, but together result in a simplified construction of the remarkable final floatable pallet.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the drawings, which drawings form a part of this specification. It is to be noted, however, that the appended drawings illustrate only typical embodiments of the invention and are therefore not to be considered limiting of its scope, for the invention may admit to other equally effective embodiments.

IN THE DRAWINGS

FIG. 1 shows an oblique pictorial view of a pallet in accordance with the present invention onto which can be installed a large industrial process plant or similar heavy load.

FIG. 2 is a cross-sectional view of the pallet illustrated in FIG. 1 taken at section 2—2.

FIG. 3 is a cross-sectional view of the pallet illustrated in FIGS. 1 and 2 taken at section 3—3 in FIG. 2.

FIG. 4 is a partial cross-sectional view of the pallet illustrated in FIGS. 1 and 2 taken at section 4—4 in FIG. 2.

FIG. 5 is a cross-sectional view of the pallet illustrated in FIGS. 1 and 2 taken at section 5—5 in FIG. 2.

FIG. 6 is a partial oblique pictorial view of a grillage element in accordance with a preferred embodiment of the present invention.

FIG. 7 is an oblique pictorial view of a row of the grillage elements shown in FIG. 6 installed as the first layer of the grillage assembly in conjunction with the bottom deck slab in an embodiment of the present invention.

FIG. 8 is an oblique pictorial view of a row of grillage elements installed as a second layer of the grillage assembly in the growing embodiment of the present invention shown in FIG. 7.

FIG. 9 is an oblique pictorial view in partial cutaway of the completed grillage assembly and including side bulkheads and top deck slab in the embodiments of the present invention also shown in FIGS. 7 and 8.

DESCRIPTION OF PREFERRED EMBODIMENTS

As noted above, the known prior art most closely related to the present invention has focused on the concept of installing or pre-installing an industrial plant, such as a chemical or petrochemical process plant, on a self-contained oceanworthy vessel or barge, either independently powered or equipped for towing by another vessel. Such a vessel is in essence a full ship having to satisfy all of the legal maritime requirements of such vessels. In spite of the advantages recognized in being able to pre-install such a plant in a convenient location, the expensive and cumbersome requirements of needing a shipyard and outfitting the vessel to be a legal maritime vessel has resulted in only token application of the concept.

The pallet structure described hereinafter is not such a vessel and has the fundamental advantages attendant to pre-installing a large industrial plant in a convenient location without the disadvantages outlined above. The pallet, which is sealed to be watertight for floatation purposes with the loaded plant thereon, can be constructed most conveniently in a low, but dry land area, near the water. Once completed, the low area can be flooded to raise the pallet and plant as a unit and for moving the entire assembly a short distance to deeper water for sea conveyance loading. At this location one or more submersible barges are positioned underneath the pallet. The entire unit of barge or barges, pallet and plant can now be transported to the location of final installation.

At the installation site, the submersible barge or barges are removed, the land is prepared for acceptance of the pallet and plant. The pallet and plant is beached or otherwise positioned into its final installation location. If desired, the pallet can even remain floating in a protected water location.

Even relatively sandy or swampy locations are suited as the final resting place since the pallet serves as a slab foundation for the plant and slab foundations are well known to be well-suited foundations for difficult conditions of soil mechanics.

Now referring to the drawings, and first to FIG. 1, a floatable pallet having the capacity to lift heavy loads is illustrated. As more fully explained hereinafter, the pallet preferably comprises a plurality of precast, prestressed elements in a unique arrangement to provide superior characteristics never before obtainable by prior art structures. In addition, the construction provides fabrication in a manner which is less complex, does not require specialized fabrication techniques or parts, and permits dependable assembly, all of which is attendantly more efficient than for prior art structures.

The pallet of the present invention is of substantial size to be capable of bearing an industrial processing plant. While the particular plant or subcomponents to be placed on the pallet will be a determining factor to the size of the pallet, the pallet may typically be 20 to 80 meters wide, 20 to 200 meters long and 4 to 15 meters deep. The pallet is a water tight concrete structure which is capable of lifting and floating huge loads. The width and length for a particular pallet are selected to provide the necessary area for the arrangement of the load. The depth is then selected by estimating the combined weight of the pallet with the load and calculating the displacement in water and then adding to that dimension a sufficient additional length so as to have a free board (height above water) of approximately 1 or more meters.

As a specific example of a pallet of the present invention, the pallet as described and illustrated by the drawings more fully hereinafter, comprises concrete grillage elements running lengthwise. Each element preferably has an edge approximately 30 centimeters wide, a vertical dimension when resting on its edge of approximately 1.5 meters, and a length of approximately 20 meters. Such an element of precast, prestressed concrete having these dimensions weighs about 1150 kilograms per running meter, or a total weight in excess of 23 metric tons. For a pallet particularly suited for carrying a complete industrial processing plant, such as an ammonia plant, the pallet will measure approximately 140 meters long by 40 meters wide, and 4.5 meters deep. A pallet constructed with regular concrete with these dimensions displaces about 2 meters of ocean water. A typical plant weighing 5,600 metric tons will cause an additional 1 meter of displacement, for an overall floating free board of over 1.5 meters, with the nominal dimensions given above.

Now referring to FIGS. 2–5, the overall construction of the pallet becomes apparent. FIG. 2 is a cross-sectional view taken at line 2—2 shown in FIG. 1. This section, therefore, is a right-angle cross-sectional view illustrating a bottom deck slab 10, a parallel top deck slab 12 connected together by side bulkheads 14 and 16, each being of the same upright dimensions, thereby spacing the top and bottom deck slabs uniformly from each other along the entire section. These side bulkheads are at right angle to the top and bottom deck slabs. In similar fashion, the ends of the pallet are closed by additional end bulkheads 15 and 17, also at right angles to the top and bottom deck slabs, as shown in FIGS. 3, 4 and 5.

Also shown in FIG. 2 is an internal bulkhead 18, secured to top deck slab 12 and bottom deck slab 10, which is spaced intermediate the side bulkheads 14 and 16 and is preferably parallel to them. The internal grillage system between the bulkheads comprise three layers 20, 22 and 24 of precast, prestressed elements, one stacked on top of the next and at successive right transverse angles.

The cross-sectional views taken at sections 3—3, 4—4, and 5—5 show that each of the three layers are divided into four quadrants. As may be best seen in FIGS. 3, 4 and 5, an internal bulkhead 30 is secured to bottom deck slab 10 and top deck slab 12 at a position intermediate end bulkheads 15 and 17 and preferably parallel to them. The ends of internal bulkhead 30 are secured to bulkheads 16 and 18. In like manner, internal bulkhead 32 is secured to bottom deck slab 10 and top deck slab 12 at a position intermediate end bulkheads 15 and 17 and preferably parallel to them. The ends of internal bulkhead 32 are secured to bulkheads 14 and 18. Hence, there is a first quadrant I or compartment defined by side bulkhead 16, internal bulkhead 30, internal bulkhead 18 and end bulkhead 17; a second quadrant II defined by side bulkhead 16, end bulkhead 15, internal bulkhead 18 and internal bulkhead 30; a third quadrant III defined by internal bulkhead 32, internal bulkhead 18, end bulkhead 15 and side bulkhead 14; and a fourth quadrant IV defined by end bulkhead 17, internal bulkhead 18, internal bulkhead 32 and side bulkhead 14.

FIG. 3 shows that lowest layer 20 of the pallet is divided into four substantially identical quadrants. The right-hand quadrants I and II each comprise a plurality of substantially identical parallel elements 26 at right angles to bulkheads 16 and 18 having ends respectively attached thereto. In like manner, the left-hand quadrants III and IV each comprise a plurality of substantially identical parallel elements 28 at right angles to bulkheads 18 and 14 having ends respectively attached thereto.

FIG. 4 shows only the intermediate layer 22 of the pallet which is divided into four substantially identical quadrants. The top two quadrants I and IV each comprise a plurality of substantially identical parallel elements 34 at right angles to bulkheads 17, 30 and 32, having ends respectively attached thereto. In like manner, the bottom two quadrants II and III each comprise a plurality of substantially identical parallel elements 36 at right angles to bulkheads 30, 32 and 15 having ends respectively attached thereto.

FIG. 5 shows that top layer 24 of the pallet is divided into four substantially identical quadrants. The right-hand quadrants I and II each comprise a plurality of substantially identical parallel elements 38 at right angles to bulkheads 16 and 18 having ends respectively attached thereto. In like manner, the left-hand quadrants III and IV each comprise a plurality of substantially identical parallel elements 40 at right angles to bulkheads 18 and 14 having ends respectively attached thereto. Assuming the same number of elements in layer 20 and 24 and the same spacing, the elements in layer 20 and 24 are in registry with each other.

Now referring to FIGS. 6–9, the sequence of constructing a simplified pallet is shown. The pallet is simplified in that what is shown is a pallet not divided by internal bulkheads, as described with respect to the pallet illustrated in FIGS. 2–5, but is in essence the method of making a single compartment of a pallet whether the pallet has only one compartment or any number of compartments. The method of making the pallet is illustrated by reference to a single compartment (quadrant I); however, it should be understood that when multiple compartment pallets are made, the steps may apply to more than the single compartment, as will be illustrated in more detail hereinafter.

The internal grillage system, illustrated by layers 20, 22 and 24, is made up of individual elements made of precast, prestressed concrete. The dimensions of the elements and the pallet as a whole are predetermined so that the elements can be formed with uniform dimensions and the junction where the individual elements cross are at uniformly spaced intervals. The individual elements 26 for the lower or bottom layer 20 and individual elements 38 for the top layer 24 may be constructed in the same manner. The individual elements 26 have a plurality of steel anchors 42 which extend from and are spaced along the two ends of the element 26. Further, a plurality of steel anchors 44 extend from and are spaced along one elongate edge of element 26. A plurality of steel seats 46 are cast into locations spaced along the opposite elongate edge of element 26 from the steel anchors 44 for the predetermined junctions between crossing elements. Anchors 42 and 44, as well as other anchors referred to, may be steel bars which extend from the elements and are bent in the form of an "L." Individual elements 34 for intermediate layer 22 are also made to predetermined dimensions of precast, prestressed concrete. A plurality of steel anchors (not shown) extend from and are spaced along each of the two ends of element 34. A plurality of steel seats 52 and 54 are cast into locations spaced along the opposite elongate edges of individual elements 34, there being a seat for each junction with each element of lower layer 22 and top layer 24.

Before work is started on the pallet, all necessary preparations of the site for making a stable and uniform pallet are accomplished. The site where this is done is in an area such that the pallet may be easily floated when the construction is completed. Site preparation includes ground leveling and preparation of a suitable and large enough surface for constructing the pallet, which surface may be a concrete foundation.

To begin making the pallet, elements 26 are positioned as shown in FIG. 7 so that the elements are each upright on edge, anchors 44 being down and seats 46 being on top. The elements are raised and are supported such that a bottom deck slab 10 may be poured under the elements 26 so as to secure each of the elements 26 to the slab 10, having the anchors 44 secured therein. Post-tension rods are positioned throughout the slab. Furthermore, projecting from two side edges of bottom slab 10 are anchors 48. A short distance from each of the two ends of slab 10 are anchors 50 extending upwardly, these rows of anchors being parallel to the respective nearby edges and are subsequently useful in the attachment of slab 10 to the end bulkheads.

Individual elements 34 which make up the intermediate layer 22 as shown in FIG. 8 are then placed in position at a 90° angle to elements 26 so that steel seats 52 are in contact with steel seats 46 of the plurality of elements 26. The seats may be of various types well-known in the art and are welded or otherwise secured together. After positioning elements 34, elements 38, which make up the top layer 24 as shown in FIG. 9, are then placed in a position at a 90° angle to elements 34 so that steel seats 56, positioned on the bottom edge of elements 38, are in contact with steel seats 54 of elements 34. These contiguous seats are then welded or otherwise secured. Extending from the top of elements 38 are steel anchors 57 which will extend into and be secured to top bulkhead 12. This provides the grillage system for the pallet of the present invention.

End bulkheads 15 and 17 are then poured so as to encompass anchors 50 extending upwardly from bottom slab 10 as well as the anchors projecting from the ends of elements 34. Extending through end bulkheads 15 and 17 are post-tension rods for tensioning. At the ends of bulkheads 15 and 17 are anchors (not shown) for securing end bulkheads 15 and 17 to the side bulkheads. Side bulkheads 14 and 16 are next poured so as to encompass and secure the anchors extending from elements 26 and 38 and the anchors extending from the side of end bulkheads 15 and 17. Means for post-tensioning the side bulkheads 14 and 16 are included. The top edges of these side bulkheads have anchors 59 projecting therefrom for securing the side bulkheads to the top bulkhead.

The pouring of the top bulkhead may be accomplished using several known techniques. Scaffolding or other supporting structure may support inverted pans or other support for the pouring of the top slab. One technique is to extend precast, prestressed roofing slabs between elements 38. The supports for the slabs may be means connected to the elements or the element may have recesses 60 on which the individual slabs may rest. The use of the slabs enables the top slab to be fully contiguous or the top slab 12 may have openings provided for either access to the internal portions of the pallet, piping, etc. Finally, top bulkhead 12 is poured over the roofing plates so as to encompass and secure top anchors projecting upwardly of edges bulkhead 15 and 17 and from the edges of said bulkhead 14 and 16, as well as from the top edge of elements 38 of layer 24 of the grillage system. Post-tension rods are positioned throughout the slab for tensioning top bulkhead 12.

It may be seen that within the bulkheads, in the respective layers, there are a plurality of uninterrupted channels between the grillage elements running in a direction parallel to the elements. This means that these channels exist crossways in the bottom and top layers and longways in the intermediate layer. The advantage of this is immediately evident when the pallet is used to support an industrial plant having a need for channels running long distances to carry pipe, electrical conduits and the like. The channels being open between the individual elements permits pipe, conduit or the like to be installed within the intervals of the pallet. Furthermore, since the edge-to-edge dimension of the upright elements is 1.5 meters, these channels can serve as manaways. Further, the channels can be used for water to accommodate ballasting of the pallet when lifting the load or when placing the pallet on a barge for transport. Likewise, feed materials, products or other substances may be stored in the channel and/or compartments.

The advantage of using such a pallet to support an industrial plant is that the plant can be fabricated in a location where materials for the plant are available, labor is perhaps more highly skilled and available, and the plant can be assembled and made ready for operation in its entirety. The pallet is then used, not only as the support for the plant during transport, but also for a permanent support once the plant reaches its destination. That is, the pallet can be beached or anchored either in a wet dock or dry-dock installation and, with relatively little effort, can be left in place as a completed operational unit. Also, a pallet of the construction set forth above has the further advantage of being transportable again, should the need arise. For example, the raw materials on which the plant operates may become depleted, making it sensible to move the plant to a new location. The pallet by itself, of course, is not a barge. Since it is not a self-propelling transport, the expensive maritime requirements for such transports do not have to be met. The advantage of a concrete structure is that it substantially eliminates corrosion problems when compared to steel.

The pallets that are described above include a pallet having no internal bulkheads and one with internal bulkheads which divide the internal configuration into four quadrants. Also, only a pallet having three layers is described. Obviously, pallets having a different division than a fourquadrant compartment division and/or a different number of grillage element layers is a matter of choice or selection well within the scope of the present invention.

The local deck area of a pallet as described may readily support a load which exerts 15 metric tons per square meter. However, if there is to be a concentrated load, then the making of the pallet provides sufficient flexibility for local reinforcing. For example, additional special elements may be positioned in the top layer 24 for supporting a particular heavy load. The grillage system of the present invention has the advantage that a concentrated load has its weight distributed through the seat contacts of the elongated elements in a spreading of radiating fashion from layer to layer and in all directions.

It is estimated, with the curing times required for concrete and the need for ensuring proper pre-stressing and/or post-tensioning of the elements, a pallet can be readily constructed within 6 months. This is sufficient time in the many places of the world where the materials and labor are available for building the typical industrial plant to be built thereon (e.g., ammonia plant, methanol plant, ethylene plant, LNG plant or part thereof) where major equipment for such plants require 12 to 24 month deliveries. Note further, that a sophisticated shipyard is not required for a pallet constructed in the manner described above, such as would be required even for a large barge having to meet maritime standards.

While particular embodiments of the invention have been shown and described, it will be understood that the invention is not limited thereto since many modifications may be made and will become apparent to those skilled in the art. For example, the transverse angle relationship of the elements from layer to layer does not have to be 90 degrees. Furthermore, some or all of the elements defining the channels can be oblique to the bulkheads, if desired.

What is claimed is:

1. The method of making a floatable pallet for lifting heavy loads, which comprises precasting in prestressed concrete a plurality of substantially identical elongated elements for each layer of the superstructure of the pallet, said elements having cast therein connectors for joining the elements to adjacent structures, casting and joining a concrete bottom slab to a row of parallel aligned and edgewise elements comprising the bottom layer, stacking and joining subsequent rows of parallel aligned and edgewise elements in layers starting with a layer on top of said bottom layer, the elements of each successive layer being transverse with the elements therebeneath, casting and joining concrete vertical bulkheads to the ends of said elements and to said bottom slab, and casting and joining a concrete top slab to the top edges of the elements in the top layer of elements and to the top edges of said vertical bulkheads.

2. The method of making a floatable pallet for lifting heavy loads, which comprises precasting a first plurality of substantially identical elongated grillage prestressed concrete elements, each of said elements having anchors projecting from the ends of one elongate edge thereof, said anchors being bent sideways for attachment to an adjacent surface, and interfacing seats spaced along the other elongate edge thereof, aligning said first plurality of said elements so as to be parallel and spaced apart from each other, each of said elements being upright and supported from the elongate edge from which said anchors project, pouring a concrete bottom deck slab so as to secure said slab to the anchors of said first plurality of elements, two edges of said slab havng anchors projecting therefrom, said anchors being bent sideways for attachment to an adjacent surface, vertically projecting anchors upwardly extending from near the other opposite ends, precasting a second plurality of substantially identical elongated grillage prestressed concrete elements, each of said elements having anchors projecting from the ends thereof, said anchors being bent sideways for attachment to an adjacent surface, and interfacing seats spaced along the elongate edges thereof, stacking said second plurality of elements upright on edge at a transverse angle to said first plurality of elements so as to be parallel, said interfacing seats of said first plurality of elements mating with the contiguous interfacing seats of said second plurality of elements, precasting a third plurality of substantially identical elongated grillage prestressed concrete elements each of said elements having anchors projecting from the ends and one elongate edge thereof, said anchors being bent sideways for attachment to an adjacent surface, and interfacing seats spaced along the other elongate edge thereof, stacking said third plurality of elements upright on edge at a transverse angle to said second plurality of elements so as to be parallel, the contiguous interfacing seats of said second plurality of elements mating with the interfacing seats of said third plurality of elements, pouring concrete side bulkheads so as to secure said side bulkheads to the contiguous adjacent anchors projecting from the ends of said first, second and third grillage elements and of said bottom slab, two of said side bulkheads resting on said bottom slab at its vertically projecting anchors, said side bulkheads including anchors projecting from the top edge thereof, said anchors being bent sideways for attachment to an adjacent surface, and pouring concrete top deck slab to as to secure said slab to the contiguous anchors of said third plurality of elements and of said side bulkheads.

3. A floatable concrete pallet for supporting a large load comprising a concrete top and bottom deck slab, side and end bulkheads secured to said top and bottom deck slab, each side and end bulkhead made of concrete and secured to produce a water tight concrete structure, and an internal grillage assembly within said concrete structure comprising multiple layers of parallel elongated pre-stressed concrete elements, the elements of the lower layer secured to said bottom deck slab and the elements of the top layer secured to the top deck slab, the elements of each successive layer from bottom to top being aligned crossways with respect to the elements of the adjacent layer, the contact areas forming load-bearing seats such that a load applied to an element of the top layer of elements is borne through the seats of the elements in successively descending layers in radiating fashion.

4. A floatable concrete pallet for lifting heavy loads, comprising a top deck, a bottom deck, side and end bulkheads of substantially uniform vertical dimensions water-tightly attached to said top and bottom decks so as to evenly space said top deck from said bottom deck, and a grillage system between said top deck and said bottom deck including a first plurality of elongated parallel and upright elements spaced apart from each other, each of said elements a precast, prestressed concrete element the elongated dimensions thereof being adjacent and secured to said bottom deck, and a second plurality of elongated parallel and upright elements spaced apart from each other, each of said second plurality of elements a precast, prestressed concrete element being stacked on and at a transverse angle to said first plurality of elements.

5. A floatable pallet in accordance with claim 4 and having a third plurality of elongated parallel and upright elements spaced apart from each other, each of said third plurality of elements a precast, prestressed concrete element being stacked on and at a transverse angle to said second plurality of elements.

6. A floatable pallet in accordance with claim 4, wherein the transverse angle of said second plurality of elements to said first plurality of elements is 90 degrees.

7. A floatable pallet in accordance with claim 4, and including, a first internal bulkhead between said top deck and said bottom deck and parallel to and spaced apart from said side bulkheads, and wherein the elongated dimensions of said first plurality of elements spans the distance between said internal bulkhead and one of said side bulkheads.

8. A floatable pallet in accordance with claim 7 and including a second internal bulkhead between said top deck and said bottom deck and parallel to and spaced apart from said end bulkheads, and wherein the elongated dimensions of said second plurality of elements spans the distance between said second internal bulkhead and said end bulkheads.

* * * * *